United States Patent [19]

Scherr et al.

[11] Patent Number: 4,848,560

[45] Date of Patent: Jul. 18, 1989

[54] FEEDING APPARATUS FOR GRID WELDING MACHINE

[75] Inventors: Rudolf Scherr; Klaus Ritter; Gerhard Ritter; Josef Ritter, all of Graz, Austria

[73] Assignee: EVG Entwicklungs-U.Verwertungs-Gesellschaft m.b.H., Graz, Austria

[21] Appl. No.: 71,016

[22] Filed: Jul. 8, 1987

[51] Int. Cl.[4] ..... B65G 47/26

[52] U.S. Cl. ..... 198/429; 198/458

[58] Field of Search ..... 198/424, 425, 427, 431, 198/458, 861.5, 432, 426, 429, 430, 458, 419.3

[56] References Cited

U.S. PATENT DOCUMENTS

| | | | |
|---|---|---|---|
| 2,297,184 | 9/1942 | Fanning | 198/861.5 X |
| 2,601,376 | 6/1952 | Eaton | 198/425 |
| 3,830,360 | 8/1974 | Graff et al. | 198/458 X |
| 3,880,301 | 4/1975 | Reilly | 198/424 X |
| 4,180,154 | 12/1979 | Andersson | 198/419.3 |
| 4,262,793 | 4/1981 | Hebenstreit et al. | 198/424 |
| 4,320,826 | 3/1982 | Kramer et al. | 198/425 |

FOREIGN PATENT DOCUMENTS

| | | |
|---|---|---|
| 1456661 | 8/1971 | Fed. Rep. of Germany . |
| 2051354 | 3/1973 | Fed. Rep. of Germany . |
| 2319003 | 12/1976 | Fed. Rep. of Germany . |
| 57-154344 | 9/1982 | Japan . |

*Primary Examiner*—Robert J. Spar
*Assistant Examiner*—D. Glenn Dayoan
*Attorney, Agent, or Firm*—Marmorek, Guttman & Rubenstein

[57] ABSTRACT

An apparatus for supplying cut-to-length longitudinal elements to the intake of a grid welding machine includes a revolving endless transverse conveyor 3 which receives the longitudinal elements 16 into open receptacles 9 and conveys them over the upper side, a turning location and a part of the lower side of the transverse conveyor 3 into the intake area of the welding machine, in which the receptacles 9 for the longitudinal elements 16 are arranged on the periphery of the transverse conveyor 3 in groups forming magazines 8*a*, 8*b* and 8*c*. The mutual distance A between these magazines being at least equal to the width B of the same. The longitudinal elements 16 from a magazine 8*c* arriving at the intake area of the welding machine, with the transverse conveyor 3 being briefly stopped, are released by a lowerable depositing device 4 previously holding the longitudinal elements in the relevant magazine, while the transverse conveyor 3 is again made to revolve so that an emptied magazine 8*a* can be filled with longitudinal elements and a magazine 8*b* already filled can pass into the intake area of the welding machine.

7 Claims, 4 Drawing Sheets

FEEDING APPARATUS FOR GRID WELDING MACHINE

The invention relates to an apparatus for supplying cut-to-length longitudinal elements to the intake of a grid welding machine and, more particularly, to apparatus having a revolving endless transverse conveyor which projects over the welding machine intake, receives the longitudinal elements laterally to the welding machine intake into open, parallel receptacles and conveys them transversely to their length over the upper side, a turning location and a part of the lower side of the transverse conveyor into the area of the welding machine intake. At the intake groups of longitudinal elements are released in turn by means of a depositing device which, initially in the raised position, closes the receptacles at the lower side of the transverse conveyor but can be lowered, whereupon the longitudinal elements are conveyed by a longitudinal conveyor into the welding machine.

Apparatus of this generic type is disclosed in DE-C-2319003. In this known apparatus, the revolving endless transverse conveyor, over its entire periphery, has directly adjoining, open receptacles which, on the upper side of the conveyor, are loaded with longitudinal elements. The filled receptacles pass over a turning location covered by baffle elements to the underside of the revolving transverse conveyor where the longitudinal elements are initially held in the receptacles by the raised depositing device and are then released downward together in a predetermined number by lowering the depositing device so that they can finally be guided into the welding machine by means of a longitudinal conveyor.

A disadvantage in this apparatus is that the transverse conveyor not only has to be stopped while the longitudinal elements are released by means of the depositing device, but in addition, while the released longitudinal elements are delivered from a deposit facility into the welding machine and the depositing device is raised again so that it can prevent the longitudinal elements contained in the following receptacles of the transverse conveyor from coming out of the receptacles prematurely. During this procedure, it is only possible subsequently to move the transverse conveyor forward, continuously or in steps, at the moderate speed still permissible for loading the empty receptacles with longitudinal elements, so that the productivity of the whole plant is relatively low.

A further disadvantage of the known apparatus is that, apart from a selective filling of the receptacles in the upper side of the endless transverse conveyor, no means is provided for changing the spacing of the longitudinal elements of the grid.

Apparatus for supplying longitudinal wires to a grid welding machine is also disclosed in the DE-B-1456661 in which apparatus a revolving endless transverse conveyor is likewise used which, over its entire periphery, has directly adjoining, open receptacles for the longitudinal elements, but in which the longitudinal elements are lifted from the upper side of the transverse conveyor. For this purpose, a transfer carriage which can be moved in a transverse direction is provided which, by means of liftable disk rollers, lifts the longitudinal elements out of the open receptacles in the upper side of the transverse conveyor, moves them transversely to their length towards the welding machine and finally guides them into the welding machine by the turning of the disk rollers. A guide device for the longitudinal elements which is likewise made as a disk roller is located in the welding machine intake, with the mutual distance between the disks of this roller being adjustable so that the spacing of the longitudinal elements in the grid to be manufactured can be changed.

This apparatus not only requires a considerably complex design, but also has the disadvantages that the transfer carriage has to be stopped in the welding machine intake until all wires can be removed from it in the longitudinal direction, and that, in view of this nonproductive time of the transfer carriage, a quick return movement of the same toward the transverse conveyor for receiving new longitudinal wires and a quick movement of the same toward the welding machine intake is necessary in order to avoid or keep as brief as possible the pauses between the individual batches of longitudinal wires fed to the welding machine. Nevertheless, such pauses and the need to move large masses quickly limit the productivity of the whole plant at least when working short longitudinal wires.

In DE-B-2051354, which bears a supplementary relationship to the DE-B-1456661, it is proposed, for avoiding a long non-productive time of the transfer carriage in the welding machine intake, to arrange the longitudinal conveyor, used for feeding the longitudinal wires into the welding machine, in such a way that it is not movable on the transfer carriage but is stationary in the welding machine intake and to lift the longitudinal wires from the transfer carriage by means of a depositing device and to deposit them onto the longitudinal conveyor so that the transfer carriage, after it is emptied and before the longitudinal wires delivered by it are worked, can return again into the loading position at the transverse conveyor. Although in this way, the non-productive time and the size of the moved masses of the transfer carriage are reduced, the overall construction of the plant, in view of the requirement for both a transverse conveyor and a transfer carriage and the requirement of separate control devices for these, is considerable, and, moreover, the requirements for the transfer carriage drive, as a result of the long travel path of the empty transfer carriage in the one direction of movement or of the loaded transfer carriage in the other direction of movement, in particular if relatively short longitudinal wires are to be worked, are considerable or can no longer be met at a reasonable expense.

A further disadvantage of the known plants working with a transfer carriage is that, in the method used for only locally changing the distance between the longitudinal elements directly in the welding machine intake, layers of the longitudinal elements result between the transfer carriage and the grid welding machine which inevitably diverge or converge, whereby fitting the longitudinal elements into the normal entry members of grid welding machines is made very difficult if not actually prevented.

It is the object of the invention to design a longitudinal-element supply apparatus for grid welding machines, of the generic type specified at the beginning in which the longitudinal elements are delivered from the lower side of the transverse conveyor, for increasing the productivity at the least possible expense, in such a way that the idle or non-productive time of the transverse conveyor previously required for releasing the longitudinal elements to a deposit facility in the welding machine intake and for conveying the released longitudinal elements from the deposit facility into the welding machine by means of the longitudinal conveyor can be greatly reduced, in particular when the distances between the longitudinal elements located on the deposit facility are to be variable by parallel displacement of the longitudinal elements in a satisfactory manner, which therefore needs time, before these elements are conveyed into the welding machine.

According to the invention there is provided apparatus for supplying cut-to-length longitudinal elements to the intake of a grid welding machine, said apparatus having a revolving endless transverse conveyor which projects over the welding machine intake, which receives said longitudinal elements laterally to the welding machine intake into open, parallel receptacles, which conveys them transversely to their length into the area of the welding machine intake and which releases them to a depositing device; said depositing device being movable between a raised position, closing said receptacles on the lower side of said transverse conveyor, and a lowered position wherein said longitudinal elements are conveyed by a longitudinal conveyor into said welding machine; wherein a plurality of magazines of closely adjacent receptacles are provided for groups of said longitudinal elements, said magazines being spaced apart at equal mutual distances (A) on the periphery of said transverse conveyor, said distance (A) between said magazines being at least equal to the width (B) of each of said magazines;

said depositing device is adapted to be lowered, after a filled one of said magazines enters into the area of said welding machine intake, and said transverse conveyor briefly stopped, in order to empty the relevant magazine;

said transverse conveyor is adapted to be moved, after said magazine emptying, at a suitable speed for loading the receptacles of a second of said magazines with longitudinal elements, and wherein, during a pause in loading, a filled magazine, following at a distance (A) behind the emptied magazine, is adapted to enter the area of the welding machine intake after said depositing device has returned to the said raised position.

In this apparatus, a magazine filled during an earlier working cycle is in each case emptied during a brief stoppage of the transverse conveyor, whereupon the transverse conveyor is moved forward at a speed which enables a magazine emptied during the preceeding working cycle to be loaded with longitudinal elements. During this loading operation, a section of the transverse conveyor which is free of receptacles moves over the intake area of the welding machine so that it is not possible for the longitudinal elements to come out of the transverse conveyor prematurely. After the loading operation, a magazine already filled during an earlier part of the working cycle, can be moved quickly, while the revolving speed of the transverse conveyor is increased, into the intake area of the welding machine for emptying, while at the same time, a section of the transverse conveyor which is free of receptacles moves past the loading point. In this way, the time required for a working cycle can be optimally utilized for loading the receptacles of the transverse conveyor and the productivity can thus be increased.

In a preferred embodiment of the invention, the longitudinal elements released in each case from a magazine of the transverse conveyor can be deposited by means of the lowerable depositing device into a stationary deposit magazine of receptacles which, in the emptying position of a filled magazine of the transverse conveyor, are aligned with the receptacles of this magazine. Again preferably, the mutual distance between the receptacles of the deposit magazine, while the parallel position of the same is maintained, can be varied in cycles by means of an adjusting apparatus between a maximum value which is equal to the mutual distance between the receptacles of the magazines of the transverse conveyor and a minimum value specified by design.

It is then possible by appropriate programming of the control circuit of the apparatus, to change the spacing of the longitudinal elements in the grid to be manufactured by cyclic parallel displacement of the longitudinal elements in the deposit magazine during the loading of a magazine of the transverse conveyor, so that no additional time is required for this and therefore there is also no loss in productivity.

One example of an apparatus according to the invention will now be described in greater detail with reference to the accompanying drawings, in which.

Figures 1, 2, 6:
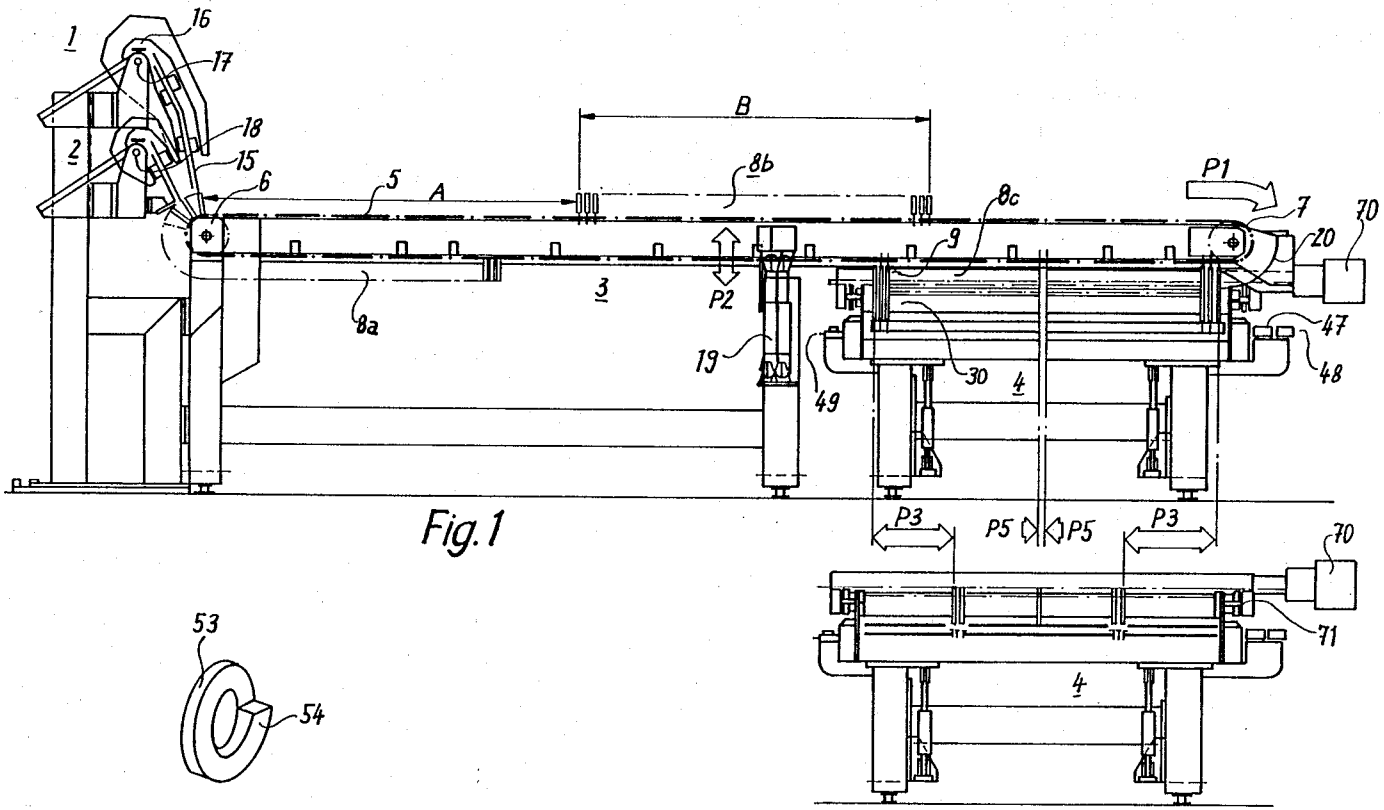
FIG. 1 shows a section along line I—I in FIG. 3 through a device according to the invention.
FIG. 2 shows a further section along line II—II in FIG. 3 through the right-hand part of the device according to FIG. 1 in another operating condition.

In FIG. 1 can be seen two devices 1 and 2 for loading a revolving endless transverse conveyor 3 with line sections 16 which are drawn off from material bundles (not shown), straightened, cut to length and are used to form the longitudinal elements of a welded grid.

The transverse conveyor 3 consists of endless chains 5 which are stretched between pulleys 6 and 7, with one of the pulleys, preferably the pulley 6 on the loading side, being a driving pulley. The chains can be made to revolve in the direction of arrow Pl by known means, for example an electric motor.

Arranged along the transverse conveyor 3 are magazines 8 in the form of receptacles 9 for receiving individual longitudinal elements 16. All the magazines 8 comprise an equal number of receptacles 9 and all receptacles inside all magazines are arranged at equal mutual distances and are the same width so that the overall width of all the magazines 8 is the same.

Each magazine 8 is at an equally large distance A from its adjacent magazines, with this mutual distance between the magazines being at least as large as the overall width of an individual magazine, and preferably slightly larger. Three magazines 8 of receptacles 9, which can be differentiated by indices a, b and c, are preferably provided, the width of which and their mutual arrangement along the chains 5 being selected such that, when the initial receptacle of the magazine 8*a* is positioned exactly opposite a sliding guide 15 of the loading device 1, via which a cut-to-length longitudinal element 16 can be directed out of the loading device into the said initial receptacle, all receptacles of the third magazine 8c are located above a stationary deposit magazine 4, at the end of the transverse conveyor 3 remote from the loading devices 1 and 2. At the same time, the second magazine 8b, with receptacles already loaded with longitudinal elements, assumes a centre or ready position, as can be recognized from FIG. 1.

If two loading devices 1 and 2 are provided, as in the exemplary embodiment shown, two longitudinal elements 16 can be loaded simultaneously into two adjacent receptacles 9 of a magazine 8 of the transverse conveyor 5. The transverse conveyor can then be indexed intermittently by two receptacle distances at a time; but the loading devices 1 and 2 can also be made such that they are pivotably mounted about axes 17 and 18 so that it is possible to move to a limited extent the sliding guides 15 along with the receptacles 9 moving at uniform speed during the revolution of the chain and thus load the receptacles 9 with longitudinal elements 16 while the chain 5 is moved continuously.

The transverse conveyor 3 is pivotably mounted about the axis of the pulley 6 and can be swung in the direction of the double arrow P2, for example by means of hydraulic cylinders 19. This enables the end of the transverse conveyor 3 located near the pulley 7 to be swung out of the position shown in FIG. 1 and adjacent to the deposit magazine 4 into a position (not shown) distanced from this magazine in order to make room for moving forward a longitudinal conveyor to be described later.

Finally, the transverse conveyor has baffle plates 20 which are still arranged coaxially with the pulleys 7, are only shown in FIG. 1 and, when a magazine 8 of receptacles moves around the pulley 7, prevent the longitudinal elements resting in the receptacles from sliding out of these receptacles prematurely.

The stationary deposit magazine 4 has the same number of receptacles 30 as each magazine 8 of the transverse conveyor 5, but with the mutual distance between the receptacles 30 being variable. In the position shown in FIG. 1 and shown schematically in FIG. 4 to a larger scale, each receptacle 30 is located exactly opposite a receptacle 9 of a magazine 8 of the transverse conveyor 3. In this aligned relative position of the receptacles, the longitudinal elements 16 can be lowered out of the receptacles 9 into the receptacles 30.

The receptacles 30, for changing the mutual distance between the longitudinal elements 16, can then be steadily displaced in the direction of the double arrows P3 in FIGS. 1 and 2 into a close spacing position (FIG. 2) and back out of this position into the receiving position (FIG. 1). For this purpose, all receptacles 30 but one are displaceably guided on bearing rails 32 by means of pulleys 31, only indicated in FIG. 4, with the bearing rails 32 extending transversely to the length of the receptacles 30 over the entire width of the deposit magazine. Moreover, graded changes of the distance between the longitudinal elements 16 can be achieved by selectively loading appropriate receptacles of the magazines 8.

Figure 5:
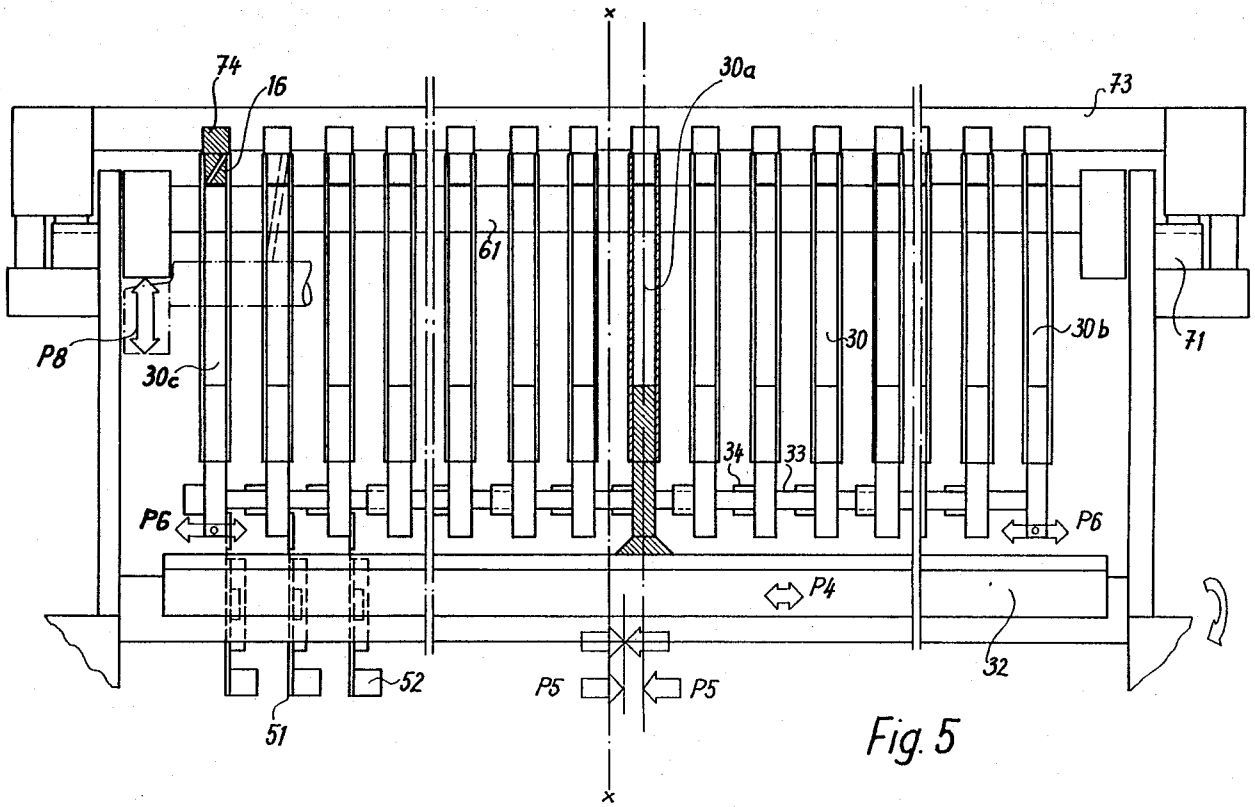

In apparatuses in which the magazines 8 of the transverse conveyor 3 as well as the deposit magazine 4 have an uneven number of receptacles 9 and 30 respectively, the centre receptacle of the deposit magazine, that is, that receptacle which is located in the plane of symmetry of the same, is rigidly and non-displaceably connected to the bearing rails 32. However, if the said groups of receptacle,, as has been assumed in FIG. 5, have an even number of receptacles 9 and 30 respectively, one of the two receptacles 30 adjacent to the plane of symmetry X—X of the deposit magazine 4, which receptacle is designated as 30a in FIG. 5, is rigidly and non-displaceably connected to the bearing rails 32, which in this case must also in turn be displaceable in the direction of the double arrow P4. The largest possible displacement stretch of a receptacle on the bearing rails 32 is equal to half the difference between the maximum and the minimum distance between adjacent receptacles 30, which is indicated in FIGS. 1 and 5 by the arrows P5. On the bearing rails 32, the receptacle 30a is in each case moved between two limit positions, the distance of which from the plane of symmetry X—X is at most equal to half the maximum or at least equal to half the minimum mutual distance of adjacent receptacles 30 from one another.

Each of the receptacles 30 is rigidly connected to a bolt 33 which passes in slideable manner through one of the adjacent receptacles and, on the other side of this adjacent receptacle, has an enlarged head part 34 which limits the distance which the two receptacles connected to one another by the bolt 33 can move apart. The bolts 33 of adjacent receptacles are offset relative to one another perpendicularly to the drawing plane of FIG. 5. They form tie rods which enable two adjacent receptacles either to move into mutual contact against one another or to move to their maximum distance apart until the head part 34 of a tie rod 33 takes along the adjacent receptacle by means of the movement of that receptacle to which the tie rod 33 is rigidly connected.

Figure 3:
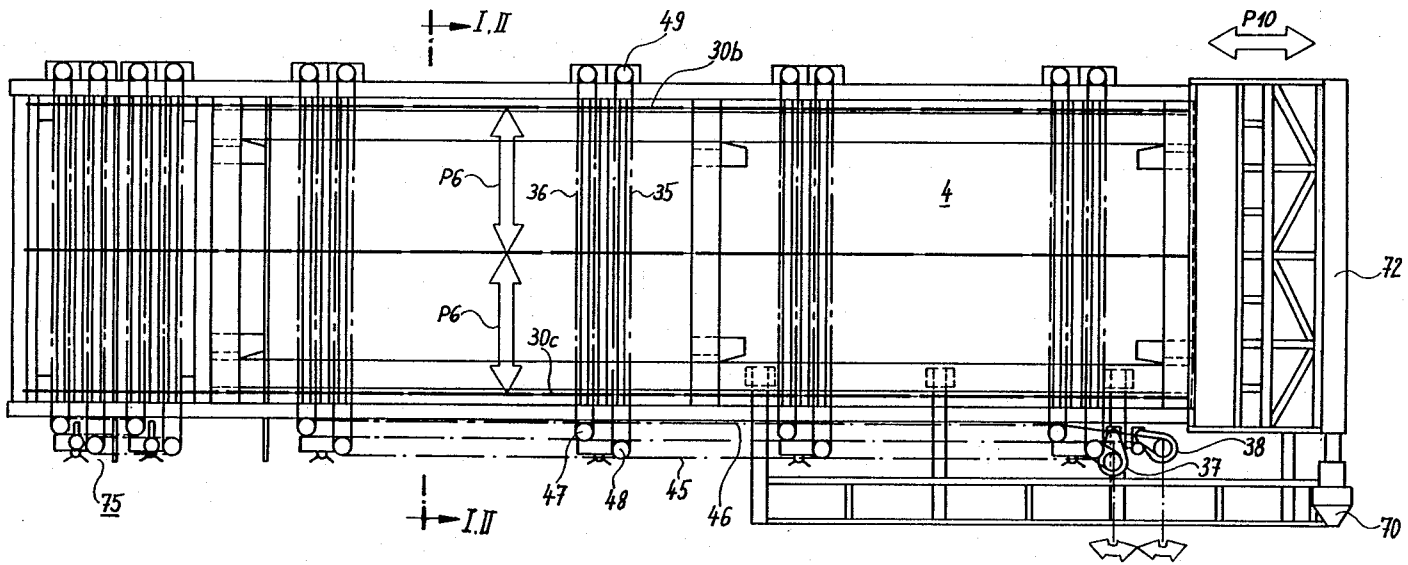
FIG. 3 shows a plan view of FIG. 1 turned through 90° with the transverse conveyor omitted.
Figure 4:
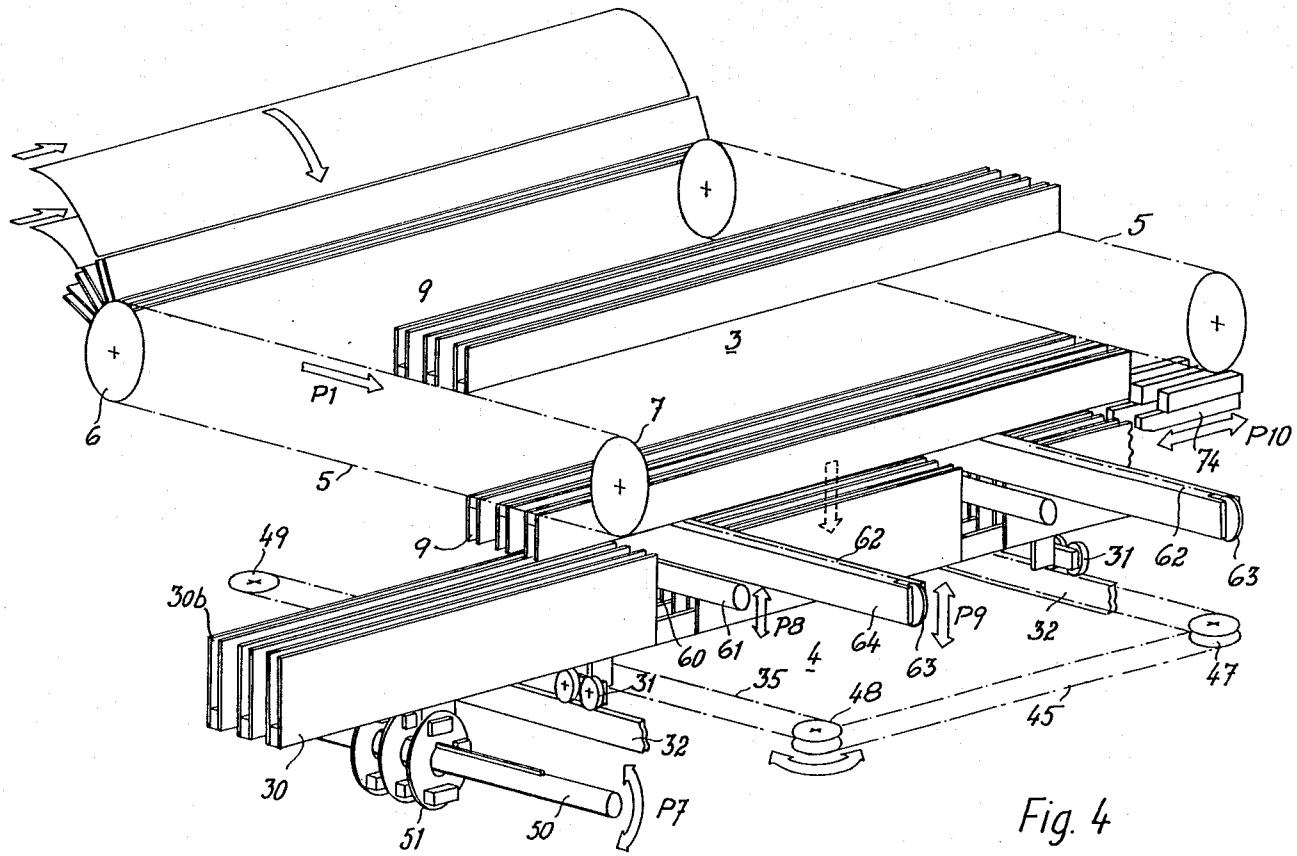
FIGS. 4 and 5 show schematic representations of essential parts of this apparatus in perspective view and in partial sectional view respectively; and, FIG. 6 shows a specially formed spacer disk for continuously establishing the mutual distance between the grid longitudinal elements.

Each of the two edge receptacles 30b and 30c is connected to a side of revolving, endless chains 35 and 36 for the sake of clarity only the chains 35 are shown in FIG. 4. The chains can be driven by motors 37 and 38 (FIG. 3) and thus move in turn the edge receptacles 30b and 30c in the direction of the double arrows P6. The motion is transmitted from the motors 37 and 38 to the chains 35 and 36, in the same way as the motion is transmitted between the groups of chains 35 and 36 arranged at distances parallel to one another, by independent transmission chains 45 and 46. During this transmission, the chains run over tension or driving pulleys 47, 48 and 49.

Spacer disks 51 which have spacer pieces 52 of different thickness attached near their periphery are arranged non-rotationally, but in longitudinally displaceable manner, along a shaft 50 rotatably mounted in the direction of the double arrow P7 in FIG. 4, but non-displaceably in the machine housing. Instead of these spacer disks 51 shown in FIG. 4, spacer disks 53 according to FIG. 6 can be provided, one end face of which forms a ramp 54 in the shape of a helical surface. This permits an infinite selection of the mutual distances between the receptacles and thus the distance between the longitudinal elements in the finished grid. In this embodiment, each receptacle 30 is preferably provided with a stop pin interacting with the helical surface 54.

In the embodiment according to FIG. 5, in which the deposit magazine 4 contains an even number of receptacles, the central spacer disk, that is, that which is located in the plane of symmetry X—X of the magazine, is rigidly and non-displaceably arranged on the shaft 50 and can therefore also limit in the direction of said axis of symmetry the travel of the receptacles on the bearing rails 32 by the receptacles being arrested at the receptacle 30a rigidly connected to these rails. Since the bearing rails 32 only have to cover small amounts of displacement, they can be driven, for example, by a hydraulic cylinder (not shown).

In order to bring the deposit magazine 4 into the position shown in FIG. 1, in which each receptacle 30 is located opposite a receptacle 9 of a magazine 8 of the transverse conveyor 3, the chains 35 and 36 are moved by the motors 37 and 38 in such a direction that the edge receptacles 30*b* and 30*c* are pulled outward. At the same time, the tie rods 33 of all receptacles, progressively from the edge toward the centre, grip the respective adjacent receptacle and pull it along until all head parts 34 of the tie rods 33 prevent further movement of the receptacles. The spacer disks 51 engaging between adjacent receptacles 30 are likewise pulled along the shaft 50 during this movement.

In this position of the receptacles, by rotating the shaft 50 and therefore also the spacer disks 51, spacer pieces of selected tbickness can be swung into the intermediate space between adjacent receptacles, which then determine the mutual distance between receptacles during the subsequent movement of the receptacles in the opposite direction.

Once the longitudinal elements 16 are transferred from the receptacles 9 of the transverse conveyor into receptacles 30 of the deposit magazine 4, the direction of movement of the chains 35 and 36 is reversed. The edge receptacles 30*b* and 30*c* now move inward and during this movement first of all strike the spacer disks 51 lying between them and their respective adjacent receptacles. They push these disks in front of them until the spacer piece 52 located precisely in the engagement position strikes the adjacent receptacle, which is now in turn also pulled along. That operation is repeated until all receptacles 30 sit tightly against the spacer pieces 52, located between them, of the spacer disks 51 according to FIG. 4 or against the ramps 54 of spacer disks according to FIG. 6.

Instead of the construction elements just described for determining the distance of adjacent receptacles 30 from one another and for moving the receptacles 30 apart and subsequently moving them together in cycles, other mechanisms, for example lazy tongs, which are driven by hydraulic cylinders, or spindle drives with engageable and disengageable nuts, can of course also be used.

The receptacles 30 of the deposit magazine 4 have apertures 60 arranged at distances in their length. These apertures 60 lie in rows running transversely to the length of the receptacles 30. Supporting rollers 61 which are adjustable in their vertical position in the direction of the double arrows P8 in FIG. 4 by known means (therefore not shown in greater detail), for example hydraulic cylinders, pass through these rows of apertures and extend transversely over the entire width of the deposit magazine 4. By these supporting rollers 61, the effective depths of the receptacles 30 can be limited in accordance with the dimensions of the longitudinal elements 16 to be supplied to the grid welding machine.

Moreover, endless chains 62 which likewise extend over the entire width of the deposit magazine 4 and are guided around tension and guide pulleys 63 are located in the apertures 60. The pulleys 63 are themselves mounted rotatably on bearing rails 64. The bearing rails 64, with all the parts fixed on them, can be moved upward by known means, again for example by hydraulic cylinders, in the direction of the double arrows P9 in FIG. 4 until the upper side of the chains sits against the downwardly pointing peripheries of the receptacles 9 of a magazine 8, or can be moved downward until this upper side of the chain lies deeper than the plane defined by the upper generatrix of the supporting rollers 61. The elements 62 to 64 just described serve as a depositing device for transferring the longitudinal elements 16 from the receptacles 9 of the transverse conveyor 3 into the receptacles 30 of the stationary deposit magazine 4.

During operation, the supporting roller 61 is first of all brought into a position in which the remaining clearance of apertures 60 of the receptacles 30 corresponds to the height of the longitudinal elements 16 to be supplied to the welding machine (cf. FIG. 5).

While the receptacles 9 of the magazine 8*a* in FIG. 1 are being loaded with longitudinal elements 16, the chains 5, as already mentioned, move in steps or alternatively at uniform speed in the direction of the arrow P1 until all receptacles of the magazine 8*a* are filled. During this movement, the magazine 8*b* already filled earlier runs around the pulley 7. The baffle plate 20 prevents longitudinal elements 16 from falling out of the receptacles 9 of the magazine 8*b* during this movement.

As soon as a receptacle 9 of the magazine 8*b* passes into the area of the lower sides of the chains 5, it butts against the upper sides of the chains 62 of the depositing device, which are located in their uppermost position. The receptacles 9 of the magazine 8*b* pull these chain sides along, which in turn now prevent the longitudinal elements 16 from falling out of the receptacles 9. The movement is continued until the magazines 8*a*, 8*b* and 8*c* of FIG. 1 pass into those positions in which the magazines 8*b*, 8*c* and 8*a* respectively are shown in FIG. 1. As soon as these positions have been reached, the chains 5 are stopped and then the chains 62 of the depositing device are lowered until their upper sides come to lie beneath the plane of the upper generatrix of the supporting rollers 61. The longitudinal elements 16 resting on the upper sides of the chains 62 follow this downward movement of the chains 62 and at the same time move out of the receptacles 9 of the magazine 8*b* into the opposite receptacles 30 of the stationary deposit magazine 4.

The chains 5 can now start moving again immediately, and at the same time the loading of the receptacles 9 of the magazine 8*c*, now located in the area of the sliding guides 15, with longitudinal elements 16 can start. Moreover, the receptacles 30 of the deposit magazine, which assume their greatest mutual distance during the transfer operation, can be brought by the motors 37 and 38, by means of the chains 35 and 36 and with the assistance of the spacer disks 51 and 53, to that distance at which the longitudinal elements 16 are to be supplied to and welded by the grid welding machine to transverse wires.

A feed carriage 72 which can be moved in the direction of the double arrow P10 in FIG. 3, for example by an electric motor 70, along a rack rail extending over the entire length of the deposit magazine 4 is provided for feeding the longitudinal elements 16 from the receptacles 30 of the deposit magazine 4.

On a beam 73 of the feed carriage 72, which beam extends transversely across the deposit magazine 4, freely displaceable feed elements 74 are provided according to FIG. 5 along this beam, each of which is constantly engaged with one of the magazine receptacles 30 and which can therefore follow each change in the spacing of the receptacles 30.

According to FIG. 3, an intermediate storage device 75 is preferably provided between the welding machine, which is not shown and is not the subject matter of this invention, and the deposit magazine 4. This intermediate storage device 75 likewise has receptacles which are identical to the receptacles 30 of the deposit magazine 4 and can likewise be set at various mutual distances by chains and spacer disks. However, these receptacles are not adjusted in cycles or mechanically, but manually and only at the start of manufacture of a certain grid type, even if the supply elements and the welding electrodes of the grid welding machine are set to the desired distances of the grid longitudinal elements.

While the receptacles 30 of the deposit magazine 4 are brought by the motors 37 and 38, by means of the chains 35 and 36, and 45 and 46, in the working cycle of the machine to the desired mutual distances between the longitudinal elements in the grid to be manufactured, the transverse conveyor 3, by means of the hydraulic cylinders 19, is swung up about the axis of the pulley 6 to the extent that the feed carriage 72 can travel through unimpeded beneath the transverse conveyor 3. The transverse conveyor 3 remains operable even in its swung-up position and can also be loaded in this position with longitudinal elements 16 by the loading device 1 and 2.

The feed carriage 72 feeds the front end of the longitudinal elements 16, travelling through beneath the swung-up transverse conveyor 3, through the intermediate storage device 75 and so far into the grid welding machine until they pass into the area of the welding electrodes. At this moment, the rear ends of the longitudinal elements 16 can still rest in the ends of the receptacles 30 of the deposit magazine 4 which are adjacent to the intermediate storage device 75.

While the welding machine joins transverse rods to the longitudinal elements 16 in cycles and in doing so also draws the longitudinal elements forward in cycles, the feed carriage 72 runs back again into its initial position, whereupon the transverse conveyor 3 can be swung back again into the position shown in FIG. 1.

As soon as the rear ends of the longitudinal elements 16 have finally come completely out of the receptacles 30 of the deposit magazine 4, the motors 37 and 38 can again be put into operation in order to draw the receptacles 30 apart again to their greatest mutual distance via the chain transmissions 35, 36, 45 and 46, whereupon the depositing device 62–64 can be lifted and the initial position shown in FIG. 1 is reached for transferring new longitudinal elements from a magazine 8 of the transverse conveyor 3 to the deposit magazine 4.

It should be mentioned that the "longitudinal elements" to be supplied by the apparatus according to the invention can either be in rod form, as in normal grid welding machines, or in the form of flat strips, as in grid welding machines which weld transverse rods into the edges of the the flat strips.

We claim:

1. An apparatus for supplying cut-to-length longitudinal elements to the intake of a grid welding machine, comprising a revolving endless transverse conveyor for conveying said longitudinal elements along a direction transverse to the axis of said longitudinal elements, said transverse conveyor including an upper side, a lower side, and two areas of reversion connecting said upper and lower sides;

a plurality of open receptacles disposed along said transverse conveyor for receiving said longitudinal elements therein, said receptacles being laid out in paralle to each other;

a plurality of magazines comprising groups of said receptacles closely adjacent to each other, said magazines being spaced apart from each other along the periphery of said transverse conveyor at equal mutual distances (A), said distance (A) between said magazines being at least equal to the distance (B) along said transverse conveyor occupied by each of said magazines;

a deposit magazine comprising a group of deposit receptacles, said deposit receptacles being movable into alignment with said open receptacles of said magazines on the lower side of said transverse conveyor so as to receive said longitudinal elements from said magazines of said transverse conveyor one magazine at a time;

a depositing device positioned adjacent said lower side of said transverse conveyor, said depositing device being movable between a raised position wherein said depositing device closes a plurality of said open receptacles on the lower side of said transverse conveyor and receives said longitudinal elements from said transverse conveyor, and a lowered position wherein said depositing device deposits said longitudinal elements into said deposit receptacles of said deposit magazine; and longitudinal conveyor means for conveying said longitudinal elements from said deposit receptacles into said grid welding machine.

2. The apparatus as claimed in claim 1, further including:

means for cyclically varying between minimum and maximum values the distance between said deposit receptacles.

3. The apparatus as claimed in claim 2, wherein:

said deposit receptacles of said deposit magazine have apertures, said apertures being aligned in rows transverse to their length, said depositing device being adapted to be lowered into said apertures and having suppporting rollers for the longitudinal elements disposed in said apertures, said supporting rollers being vertically adjustable and freely rotatable.

4. The apparatus as claimed in claim 3 wherein:

said depositing device comprises endless chains which are vertically adjustable, each of said endless chains having guide pulleys, a distance between said guide pulleys being greater than the distance (B) along said transverse conveyor occupied by each of said magazines, said chains being movable between an upper position in which they close the receptacles located on the lower side of said transverse conveyor, and a lower position wherein they are located lower than the supporting rollers.

5. The apparatus as claimed in claim 2, wherein:

said deposit receptacles of said deposit magazine are arranged on bearing rails, said bearing rails running transversely to the length of said deposit receptacles, a deposit receptacle adjacent to the center of said deposit magazine being rigidly connected to said bearing rails, and the other deposit receptacles being displaceable along said bearing rails.

6. The apparatus as claimed in claim 8, wherein:

said transverse conveyor is pivotally mounted at one of said areas of reversion, and said transverse conveyor comprises a free end at said other area of reversion, said transverse conveyor being pivotable upward at said free end.

7. The apparatus as claimed in claim 1, wherein:

said longitudinal conveyor means comprises a feed carriage for said longitudinal elements, said feed carriage extending transversely across the width of said deposit magazine and being movable in a direction parallel to said deposit receptacles;

said longitudinal conveyor means further comprising feed elements fixed on said feed carriage, said feed elements constantly engaging said deposit receptacles of said deposit magazine and being freely displaceable in a direction transverse to said deposit receptacles.

* * * * *